US007463848B2

(12) United States Patent
Tomatsu et al.

(10) Patent No.: US 7,463,848 B2
(45) Date of Patent: Dec. 9, 2008

(54) IMAGE FORMING APPARATUS HAVING A STATE IN WHICH A CONVEYING ROLLER IS PRESSED TOWARD A RECORDING MEDIUM

(75) Inventors: Yoshiya Tomatsu, Kasugai (JP); Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 84 days.

(21) Appl. No.: 11/616,554

(22) Filed: Dec. 27, 2006

(65) Prior Publication Data

US 2007/0147892 A1 Jun. 28, 2007

(30) Foreign Application Priority Data

Dec. 27, 2005 (JP) ..... 2005-375589

(51) Int. Cl.
*G03G 15/00* (2006.01)

(52) U.S. Cl. ..... 399/124; 399/21

(58) Field of Classification Search ..... 399/124, 399/107, 125, 122, 21
See application file for complete search history.

(56) References Cited

U.S. PATENT DOCUMENTS 5,319,432 A * 6/1994 Akashi et al. ..... 399/124
5,787,326 A * 7/1998 Ogawa et al. ..... 399/124
5,974,290 A * 10/1999 Inoue ..... 399/124
7,346,294 B2 * 3/2008 Lee ..... 399/124
2004/0175204 A1 * 9/2004 Kouzu ..... 399/124
2004/0228655 A1 * 11/2004 Sunohara ..... 399/124
2005/0163533 A1 * 7/2005 Hashimoto et al. ..... 399/124
2005/0220488 A1 * 10/2005 Fujita et al. ..... 399/124
2006/0002738 A1 * 1/2006 Kurita ..... 399/124
2006/0239715 A1 * 10/2006 Lee et al. ..... 399/122
2007/0025763 A1 * 2/2007 Ishii et al. ..... 399/122
2007/0031165 A1 * 2/2007 Lee et al. ..... 399/124
2007/0147919 A1 * 6/2007 Lim ..... 399/388
2007/0248377 A1 * 10/2007 Palumbo et al. ..... 399/107

FOREIGN PATENT DOCUMENTS

JP 62-108352 U 7/1987
JP 2068678 3/1990

(Continued)

OTHER PUBLICATIONS

JP Office Action dtd May 7, 2008, JP App 2005-375589.

*Primary Examiner*—Sophia S Chen
(74) *Attorney, Agent, or Firm*—Banner & Witcoff, Ltd.

(57) ABSTRACT

An image forming apparatus including an image forming unit which forms an image on a recording sheet, a casing which houses the image forming unit and holds the image forming unit, a conveying roller which contacts the recording sheet to be conveyed in the casing, conveys the recording sheet, and is supported to rotate by the casing, a cover which opens and closes an opening formed in a portion of the casing which corresponds to the conveying roller, and a pushing unit. If the cover is closed, the pushing unit exerts a pushing force to push the conveying roller toward the recording sheet to act on a spindle of the conveying roller. If the cover is opened, the pushing unit releases the pushing force by moving in association with the cover.

9 Claims, 10 Drawing Sheets

FOREIGN PATENT DOCUMENTS

| | | | | |
|---|---|---|---|---|
| JP | 02-124588 | A | * | 5/1990 |
| JP | 7-215526 | A | | 8/1995 |
| JP | 8-91635 | A | | 4/1996 |
| JP | 11-310356 | A | | 11/1999 |
| JP | 11310356 | | | 11/1999 |
| JP | 11343046 | | | 12/1999 |
| JP | 2000-305390 | A | | 11/2000 |

* cited by examiner

IMAGE FORMING APPARATUS HAVING A STATE IN WHICH A CONVEYING ROLLER IS PRESSED TOWARD A RECORDING MEDIUM

CROSS-REFERENCE TO RELATED APPLICATION

This application claims priority from Japanese Patent Application No. 2005-375589, filed on Dec. 27, 2005, the entire subject matter of which is incorporated herein by reference.

TECHNICAL FIELD

The present invention relates to an image forming apparatus and more particularly to an image forming apparatus for electronic photography such as a laser printer or a copying machine.

BACKGROUND

The image forming apparatus usually prints an image of letters or the like on a recording face of a recording sheet while conveying the recording sheet on a conveying path set in the image forming apparatus (or a casing thereof). In order to remove a recording sheet jammed at a point along a conveying path, JP-UM-A-62-108352 discloses the formation of an opening in a portion of a casing corresponding to conveying rollers and arranging one of the conveying rollers in an opening/closing cover for opening/closing the opening.

SUMMARY

Here, the conveying rollers include a first roller which is arranged on one side across the recording sheet, and a roller (which will be called as "second roller"), which is arranged on the other side. These first and second rollers convey the recording sheet while clamping it between the first roller and the second roller.

When a position of the second roller changes relative to the first roller, contacting facial pressure between the first and second rollers and the recording sheet changes. Thus, the recording sheet cannot be stably conveyed.

If the contacting facial pressure excessively rises, the recording sheet may be damaged by roller traces, which occur when the recording sheet is clamped between the first and second rollers. On the other hand, if the contacting facial pressure excessively drops, the recording sheet cannot be sufficiently clamped so that it cannot be stably conveyed.

The opening/closing cover is connected to the casing through a moving unit such as a hinge mechanism, and this hinge mechanism usually has a looseness to allow rotating (or rocking) motions. Thus, the opening/closing cover has a low positional precision relative to the casing.

If one of the conveying rollers (e.g., the first roller) is arranged in the opening/closing cover as disclosed in JP-UM-A-62-108352, the position of the second roller to the first roller may drastically change.

If the first roller is instead arranged on a casing side, the position of the second roller relative to the first roller can be prevented from drastically changing. However, the following problem will occur.

Namely, in order to convey the recording sheet stably, it is necessary to set the contacting facial pressure between the conveying rollers and the recording sheet to at least a predetermined facial pressure, as has been described hereinbefore.

If the conveying rollers are so arranged on the casing side that the contacting facial pressure between the conveying rollers and the recording sheet is at least the predetermined facial pressure, the contacting facial pressure rises to a relatively high level. Therefore, a high force may be required for removing the recording sheet and the task of removing a jammed recording sheet may be difficult.

In the invention disclosed in JP-UM-A-62-108352, when the opening/closing cover is opened to remove the jammed recording sheet, the roller arranged in the opening/closing cover disengages the recording sheet together with the opening/closing cover so that the jammed recording sheet can be easily removed. However, as described above, the contacting facial pressure changes so drastically as to make it difficult to convey the recording sheet stably.

Aspects of the present invention enable removal of a jammed recording sheet easily while conveying the recording sheet stably.

DETAILED DESCRIPTION

<General Overview>

Figure 1:
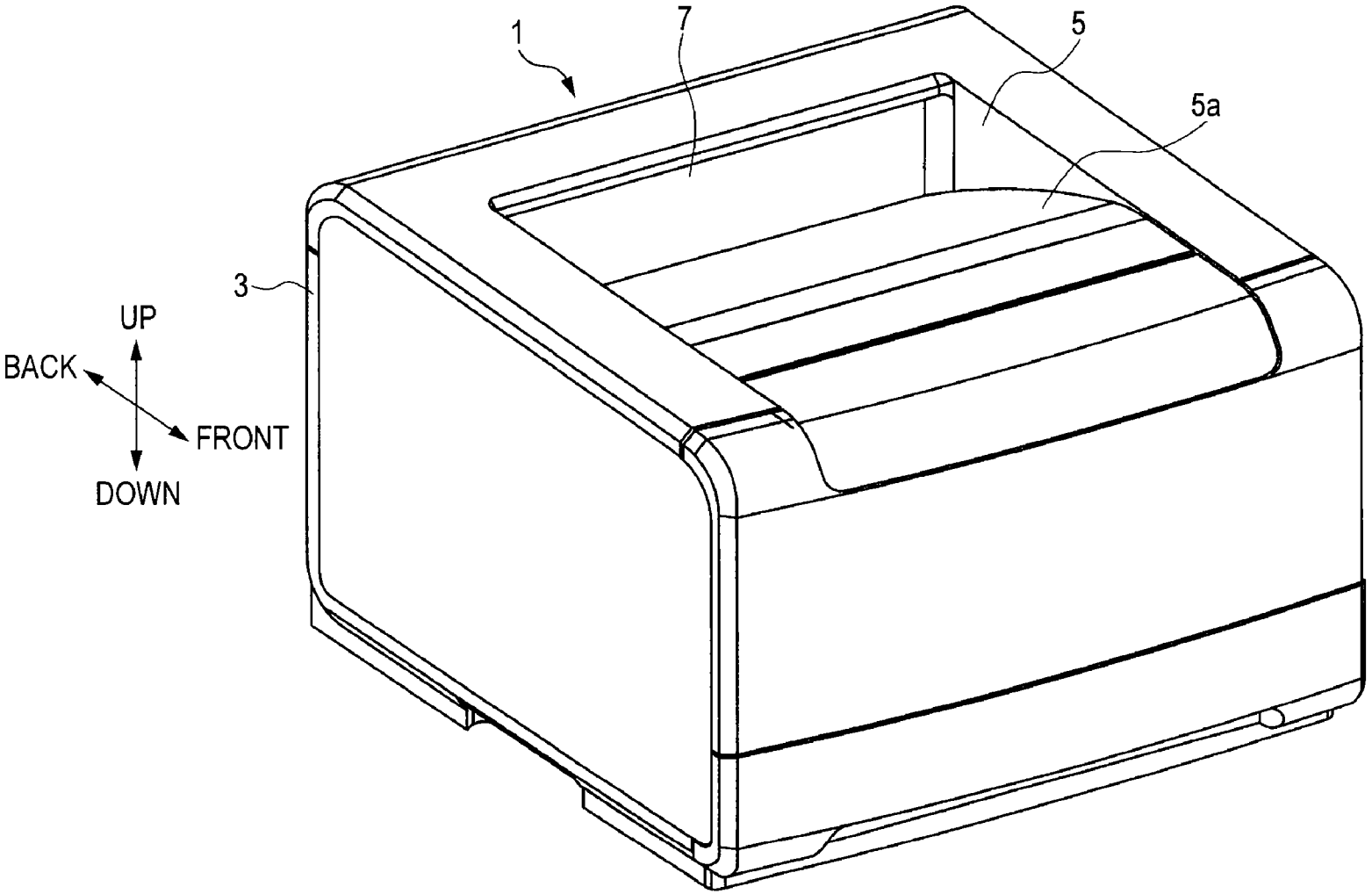
FIG. 1 is a perspective view showing the exterior of a laser printer according to an aspect of the invention.

A first aspect of the invention provides an image forming apparatus comprising: an image forming unit which forms an image on a recording sheet; a casing which houses the image forming unit and holds the image forming unit; a conveying roller which contacts the recording sheet to be conveyed in the casing, conveys the recording sheet, and is supported to rotate by the casing; a cover which opens and closes an opening formed in a portion of the casing which corresponds to the conveying roller; and a pushing unit, wherein if the cover is closed, the pushing unit exerts a pushing force to push the conveying roller toward the recording sheet to act on a spindle of the conveying roller, and wherein if the cover is opened, the pushing unit releases the pushing force by moving in association with the cover.

Accordingly, if the cover (4) is closed, the conveying roller (40) is pushed toward the recording sheet. The contacting facial pressure between the recording sheet and the conveying roller (40) can be set to at least a predetermined facial pressure or higher.

On the other hand, if the cover (4) is opened, the pushing force is released in association with the cover (4). Accordingly, the contacting facial pressure between the recording sheet and the conveying roller (40) can be set to a level lower than the predetermined facial pressure.

Therefore, if the cover (4) is closed, the contacting facial pressure between the recording sheet and the conveying roller (40) can be set to the predetermined facial pressure or higher thereby to convey the recording sheet stably. On the other hand, if the cover (4) is opened, the contacting facial pressure between the recording sheet and the conveying roller (40) can be lowered to easily remove a clogged recording sheet.

According to a second aspect of the invention, the cover includes a protrude portion on a conveying roller side thereof, the protrude portion protruding toward the conveying roller and contacting the spindle if the cover is closed and constituting the pushing unit. The conveying roller is arranged on a cover side of the recording sheet to be conveyed.

The conveying roller (40) is arranged on the side of the cover (4) of the recording sheet to be conveyed. Thus, the conveying roller (40) can be more easily pushed toward the recording sheet than the case in which the conveying roller (40) is arranged on the opposite side of the cover (4) across from the recording sheet to be conveyed.

If the conveying roller (40) is arranged on the opposite side of the cover (4) across the recording sheet to be conveyed, a lever mechanism or the like is needed for inverting the direction of the pushing force by the protrusions (4*a*). On the other hand, as in the invention, if the conveying roller (40) is arranged on the side of the cover (4) of the recording sheet to be conveyed, the aforementioned lever mechanism is not necessary. Accordingly, the conveying roller (40) can be easily pushed toward the recording sheet by the protrusions (4*a*). Further, the object of the invention can be achieved while suppressing the size enlargement and the manufacturing cost rise of the image forming apparatus.

According to a third aspect of the invention, the pushing unit is disposed at a position within a range corresponding to a conveying path, on which a recording sheet having a minimum sheet width direction is conveyed.

Even in the case the recording sheet having the minimum sheet width direction is conveyed, the contacting facial pressure between the conveying roller (40) and the recording sheet can be set to the predetermined facial pressure or higher. Accordingly, even the small recording sheet can be stably conveyed.

Here, the "sheet width direction" is a direction perpendicular to the conveying direction of the recording sheet and the thickness direction of the recording sheet.

According to a fourth aspect of the invention, the conveying roller is arranged to be substantially symmetric with respect to a substantially central portion in an axial direction of the spindle, and contact positions between the pushing unit and the spindle are substantially symmetric with respect to the substantially central portion in the axial direction of the spindle.

A plurality of contact portions exist between the recording sheet and the intermediate conveying roller (40), and these contact portions are substantially symmetric with respect to the axially central portion. This makes it possible to prevent the recording sheet in advance from being inclined with respect to the conveying direction.

According to a fifth aspect of the invention, the spindle is made of a resin.

As a result, the spindle (40*a*) can be easily warped so that the conveying roller (40) can be easily displaced to establish the predetermined contacting facial pressure.

In the present invention, the conveying roller (40) is pushed toward the recording sheet thereby to retain the contacting facial pressure between the conveying roller (40) and the recording sheet. Due to the manufacturing size dispersion of the opening/closing cover (4) or the pushing unit (4*c*) or the size dispersion in assembling the opening/closing cover (4) in the casing (3), the conveying roller (40) may be excessively displaced toward the recording sheet.

If the outer circumference side of the conveying roller (40) is so rigid as to not elastically deform when the conveying roller (40) is excessively displaced toward the recording sheet, the contacting facial pressure between the intermediate conveying roller (40) and the recording sheet may become excessive so as to damage the recording sheet, as has been described hereinbefore.

On the contrary, according to a sixth aspect of the invention, at least an outer circumference of the conveying roller is made of an elastically deformable material. Even if the intermediate conveying roller (40) is excessively displaced toward the recording sheet, the intermediate conveying roller (40) is deformed at outer circumference sides so that the excessive displacement can be absorbed.

Therefore, it is possible to prevent the contacting facial pressure between the conveying roller (40) and the recording sheet in advance from becoming excessively high. Accordingly, the damage of the recording sheet can be prevented in advance.

According to a seventh aspect of the invention, the image forming apparatus further comprises a plurality of rollers which push the recording sheet toward the conveying roller at positions which confront the conveying roller along the rotational direction of the conveying roller.

According thereto, the recording sheet can be wound on the outer circumference of the conveying roller (40). Thus, the bending tendency (or curl), which occurs in the recording sheet, can be eliminated.

In order to remove the bending tendency (or the curl) having occurred at the recording sheet, it is necessary to curve the recording sheet forcibly in the direction opposite to that of the bending tendency, as has been described hereinbefore. As a result, clogging (or jamming) of the recording sheet is liable to occur at the portion where the rollers for removing the bending tendency (or the curl) are disposed.

Therefore, it is more effective to apply the invention to the portion where the rollers are disposed for eliminating the bending tendency (or the curl).

According to an eighth aspect of the invention, the image forming unit includes a fixing unit which heats a toner transferred to the recording sheet and fixes the toner on the recording sheet, and the conveying roller is arranged on a downstream side of the fixing unit in a conveying direction of the recording sheet.

Moreover, the bending tendency is liable to occur especially at the fixing unit (90). Thus, it is more effective to apply the invention to the downstream side of the fixing unit (90) in the conveying direction.

According to a ninth aspect of the invention, the conveying roller conveys the recording sheet discharged from the image forming unit and conveys the recording sheet which is to be conveyed again to the image forming unit after discharge from the image forming unit.

According to a tenth aspect of the invention, the pushing unit includes a supporting unit which supports the spindle.

Incidentally, the parenthesized reference numerals of the aforementioned elements are examples indicating the corresponding relations to the specific elements, as described in the later aspects. The invention should not be limited to those which are indicated by the parenthesized reference numerals.

<Illustrative Aspects>

With reference to the accompanying drawings, aspects of the invention will be described, in which an image forming apparatus according to the invention is applied to an apparatus such as a laser printer.

First Exemplary Embodiment

1. Exterior Structure of Laser Printer

Figure 2:
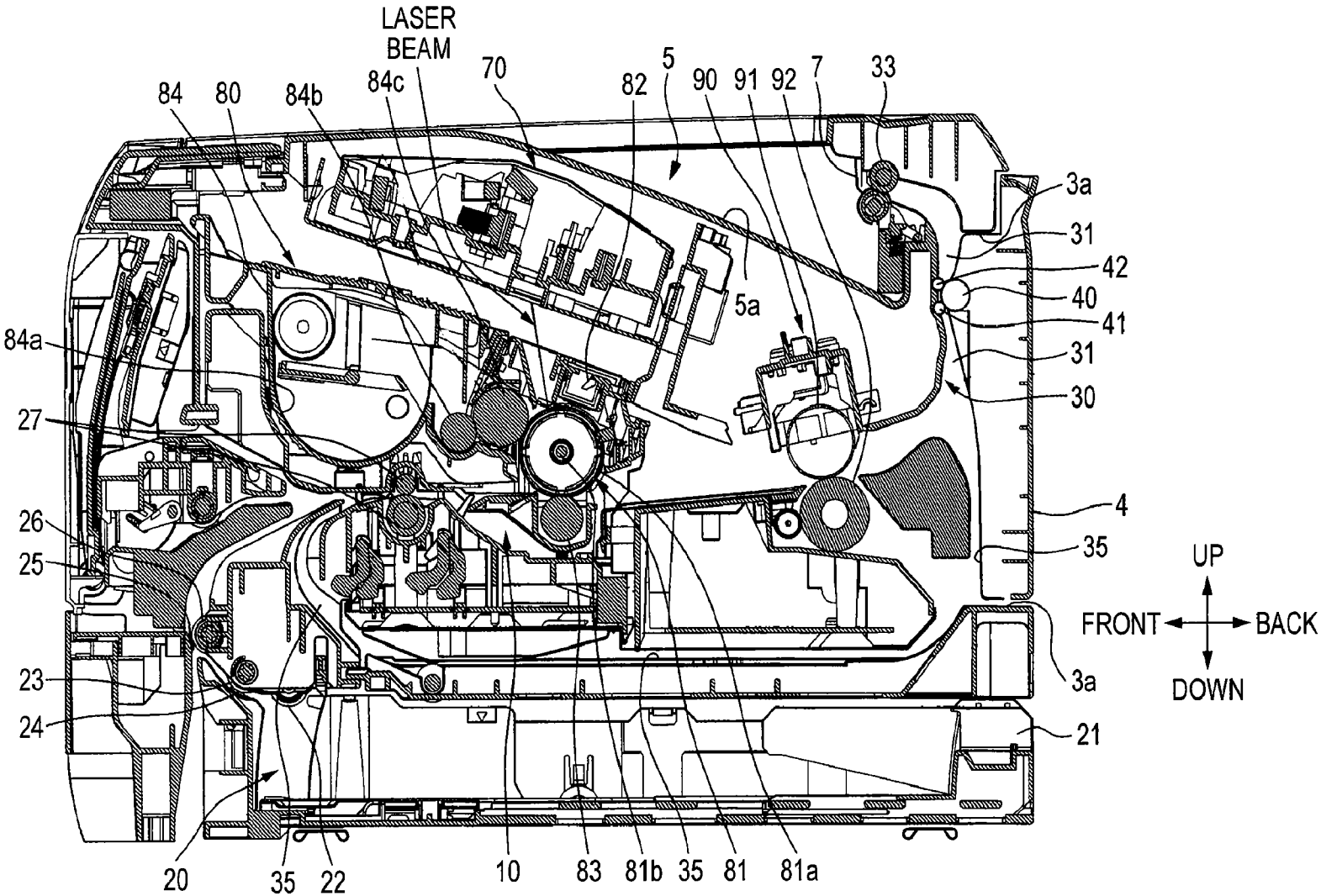
FIG. 2 is a sectional side view of the laser printer.

FIG. 1 is a perspective view showing the exterior of a laser printer 1 according to a first exemplary embodiment, and FIG. 2 is a sectional side view of the laser printer 1.

The laser printer 1 has a casing 3, in which a later-described image forming unit 10 is housed. An opening 3*a* is provided in the casing 3 at a position corresponding to the later-described intermediate conveying rollers 40. The opening 3*a* is opened/closed by an opening/closing cover 4 connected in a rocking manner to the casing 3 through a hinge mechanism (not shown) disposed on the lower end side of the opening 3*a*.

The opening 3*a* and the opening/closing cover 4 are manually opened at the time of maintenance for removing recording sheets which have clogged the intermediate conveying rollers 40 or a conveying path 31.

A discharge tray 5 is disposed on the upper face side of the casing 3. The recording sheets discharged from the casing 3 after printing are stacked on the discharge tray 5. This discharge tray 5 is constituted to have a sloped face 5*a* which increases in slope the farther the distance from the casing 3 the closer to the back side. A discharge port 7, from which the printed recording sheet is discharged, is provided on the rear end side of the slope face 5*a*.

In this example, sheets such as paper sheets or OHP sheets may be used as the recording sheets.

2. Internal Structure of Laser Printer

In FIG. 2, the image forming unit 10 constitutes an image forming unit for forming images on the recording sheets, and a feeder unit 20 constitutes a portion of a conveying unit for feeding the recording sheets to the image forming unit 10.

A discharge chute 30 constitutes a guide member for causing the recording sheet having formed the image at the image forming unit 10 to make a U-turn of about 180 degrees in the conveying direction so as to guide the recording sheet into the discharge port 7 formed above a fixer unit 90.

Moreover, the intermediate conveying rollers 40 for conveying the recording sheet to the discharge port 7 are disposed at the intermediate portion of the conveying path 31, which is formed by the discharge chute 30. Discharge rollers 33, which discharge the conveyed recording sheet to the discharge tray 5, are disposed at the most downstream portion of the conveying path 31.

The discharge rollers 33 of this example have a forward/backward switching function to reverse the rotating direction. When the image is to be formed (or printed) on only one recording face of the recording sheet, the recording sheet is discharged and is conveyed to the discharge tray 5. On the other hand, in case images are to be formed on both the front and back sides of the recording sheet, the rotating direction is reversed when the trailing end portion of the conveyed recording sheet reaches the discharge rollers 33. Thereby, the recording sheet is conveyed toward a double-sided printing path 35.

2.1. Feeder Unit

The feeder unit 20 includes a sheet feed tray 21, a sheet feed roller 22, a separating roller 23 and a separating pad 24. The sheet feed tray 21 is housed in the lowermost portion of the casing 3. The sheet feed roller 22 is disposed above the front end portion of the sheet feed tray 21 for conveying the recording sheets to the image forming unit 10. The separating roller 23 and the separating pad 24 separate one by one the recording sheets to be conveyed to the sheet feed roller 22. The recording sheets, which are stacked on the sheet feed tray 21, are conveyed, after being U-turned on the front side in the casing 3, to the image forming unit 10 arranged substantially at the center portion in the casing 3.

In the recording sheet conveying path from the sheet feed tray 21 to the image forming unit 10, a paper dust removing roller 25 is provided on the outer side of the top portion of the substantially U-shaped turn. The paper dust removing roller 25 removes the paper dust or the like which has stuck to the image forming face (or the printing face) of the recording sheet. An opposed roller 26 for pushing the conveyed recording sheet to the paper dust removing roller 25 is provided on the inner side of the top portion.

At the entrance of the image forming unit 10 of the conveying path from the sheet feed tray 21 to the image forming unit 10, there are arranged a pair of resister rollers 27 for applying a conveying resistance to the recording sheet thereby to arrange the conveyed state of the recording sheet.

2.2. Image Forming Unit

The image forming unit 10 includes a scanner unit 70, a process cartridge 80 and a fixer unit 90.

2.2.1. Scanner Unit

The scanner unit 70 is disposed in the upper portion of the casing 3 and forms an electrostatic latent image on the surface of a photosensitive drum 81. Specifically, the scanner unit 70 includes a laser light source, a polygon mirror, an fθ lens and a reflecting mirror.

The laser beam, which is emitted from a laser light source and based on the image data, is deflected by the polygon mirror and passed through the fθ lens. The optical path is then folded back and bent downward by the reflecting mirror so that the surface of the photosensitive drum 81 is irradiated with the laser beam to form the electrostatic latent image.

2.2.2. Process Cartridge

The process cartridge 80 is removably arranged in the casing 3 on the lower side of the scanner unit 70. This process cartridge 80 is constituted to include the photosensitive drum 81, a charger 82, a transfer roller 83 and a developer cartridge 84.

The photosensitive drum 81 acts as an image carrying unit for carrying the image to be transferred to the recording sheet. The photosensitive drum 81 is constituted to include a cylindrical drum body 81*a* having its outermost layer made of a positively chargeable photosensitive layer from polycarbonate, and a drum shaft 81*b* extending axially and longitudinally for supporting the drum body 81*a* rotatably.

The charger 82 acts as a charging unit for charging the surface of the photosensitive drum 81, and is so arranged obliquely above the back side of the photosensitive drum 81 to confront the photosensitive drum 81 across a predetermined spacing so that it does not contact the photosensitive drum 81. The charger 82 according to this example adopts a scorotron type charger for charging the surface of the photosensitive drum 81 substantially homogeneously with a positive charge from corona discharge.

The transfer roller 83 is arranged to confront the photosensitive drum 81 and to rotate in association with the photosensitive drum 81. This transfer roller 83 acts as a transfer unit for transferring the toner having stuck to the surface of the photosensitive drum 81 to the printing surface of the recording sheet. The transfer roller 83 transfers the toner by causing the charge (i.e., the negative charge), which is opposed to the charge at the photosensitive drum 81, to act on the recording sheet from the side opposed to that of the printing face.

The discharge chute 30 includes a toner housing chamber 84*a* housing the toner, a toner feed roller 84*b* for feeding the toner to the photosensitive drum 81, and a developing roller 84*c*.

The toner, which is housed in the toner housing chamber 84*a*, is fed toward the developing roller 84*c* by the rotation of the toner feed roller 84*b*. The toner fed toward the developing roller 84*c* is carried on the surface of the developing roller 84*c*. After regulated to a predetermined constant (or homogeneous) thickness, the toner is fed to the surface of the photosensitive drum 81 exposed at the scanner unit 70.

2.2.3. Fixing Unit

The fixing unit 90 is arranged on the slip stream side of the photosensitive drum 81 in the conveying direction of the recording sheet. The fixing unit 90 fixes the toner, which is transferred to the recording sheet, by heating and melting the toner. Specifically, the fixing unit 90 includes a heating roller 91 and a pressure roller 92. The heating roller 91 is arranged on the printing face side of the recording sheet for applying the conveying force, while heating the toner, to the recording sheet. The pressure roller 92 is arranged on the opposite side of the heating roller 91 across the recording sheet and pushes the recording sheet toward the heating roller 91.

Incidentally, the heating roller 91 is a driven unit such as a motor (not shown), and the pressure roller 92 follows and rotates while receiving the rotating force from the heating roller 91 through the recording sheet contacting the heating roller 91.

2.2.4. Actions of Image Forming Unit

The drum 81 is homogeneously positively charged by the charger 82 as it rotates, and is then exposed to the laser beam which is irradiated from and scanned at a high speed by the scanner unit 70. As a result, the electrostatic latent image corresponding to the image to be formed on the recording sheet is formed on the surface of the photosensitive drum 81.

Next, the toner, which is carried on the developing roller 84*c* and positively charged, is fed to the electrostatic latent image formed on the surface of the photosensitive drum 81 when brought to face and contact with the photosensitive drum 81 by the rotation of the developing roller 84*c*. Namely, the toner is fed to such an exposed portion of the homogeneously positively charged surface of the photosensitive drum 81 as has been exposed to the laser beam to lower its potential. As a result, the toner image by the reversal phenomenon is carried on the surface of the photosensitive drum 81.

The toner image, which is carried on the surface of the photosensitive drum 81, is transferred to the recording sheet by the transfer bias applied to the transfer roller 83. The recording sheet having the toner image transferred is conveyed to and heated by the fixing unit 90 so that the toner transferred as the toner image is fixed on the recording sheet. Thereby, the image formation is completed.

Figure 3:
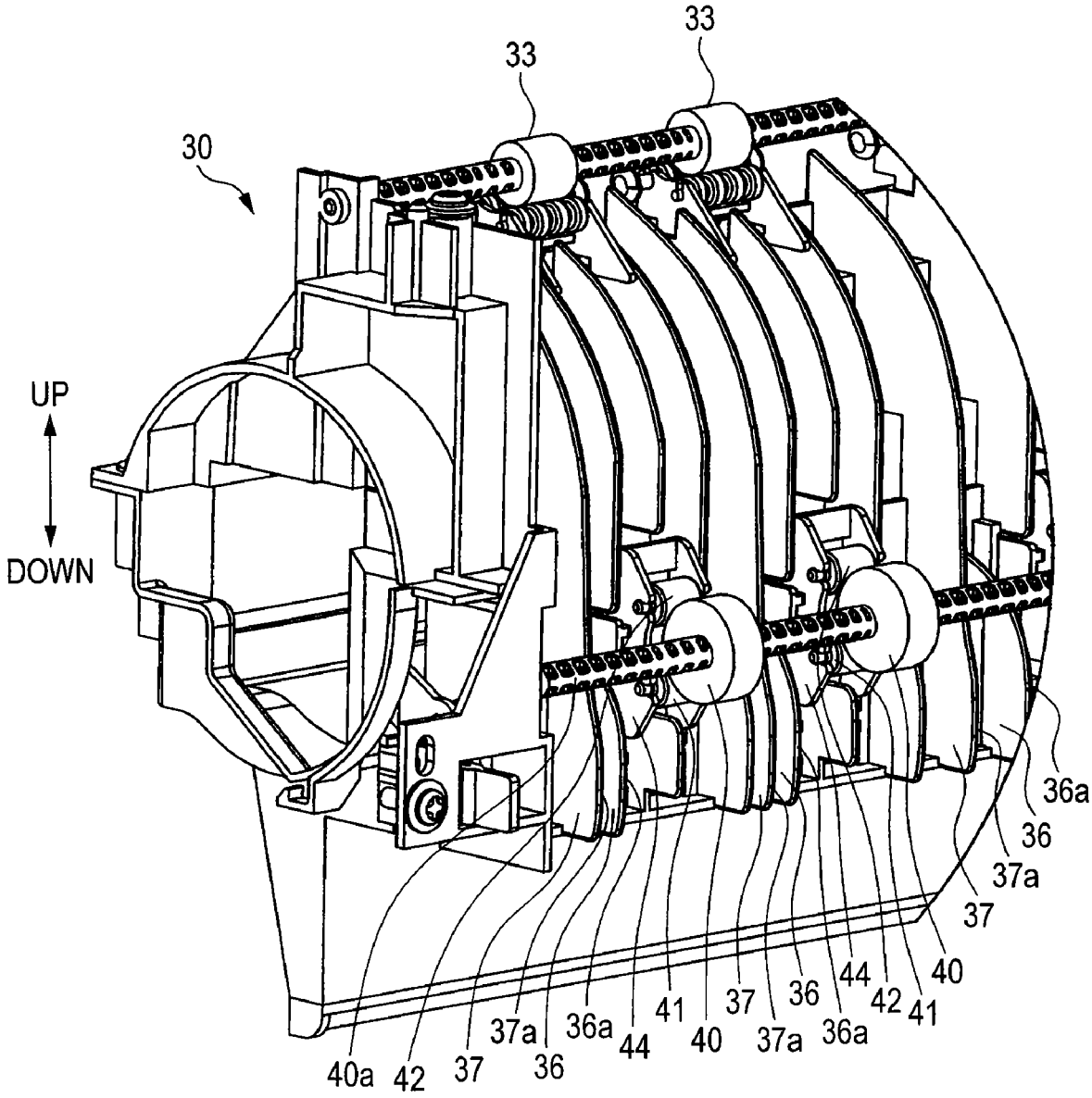
FIG. 3 is an enlarged view of a discharge chute and intermediate conveying rollers.
Figure 4:
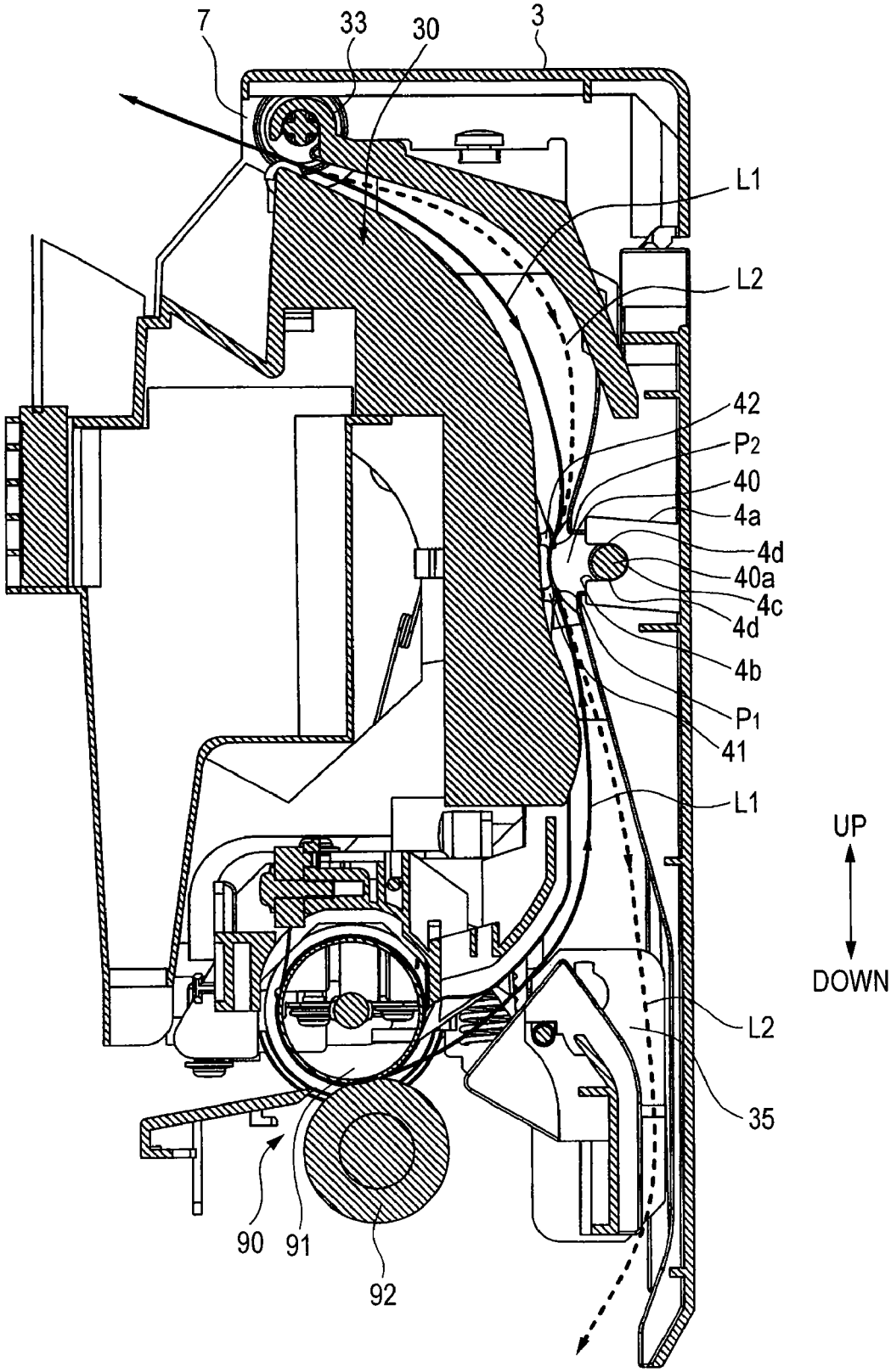
FIG. 4 is a sectional diagram view taken of FIG. 3 from a plane normal to the axial direction of the intermediate conveying rollers.
Figure 5:
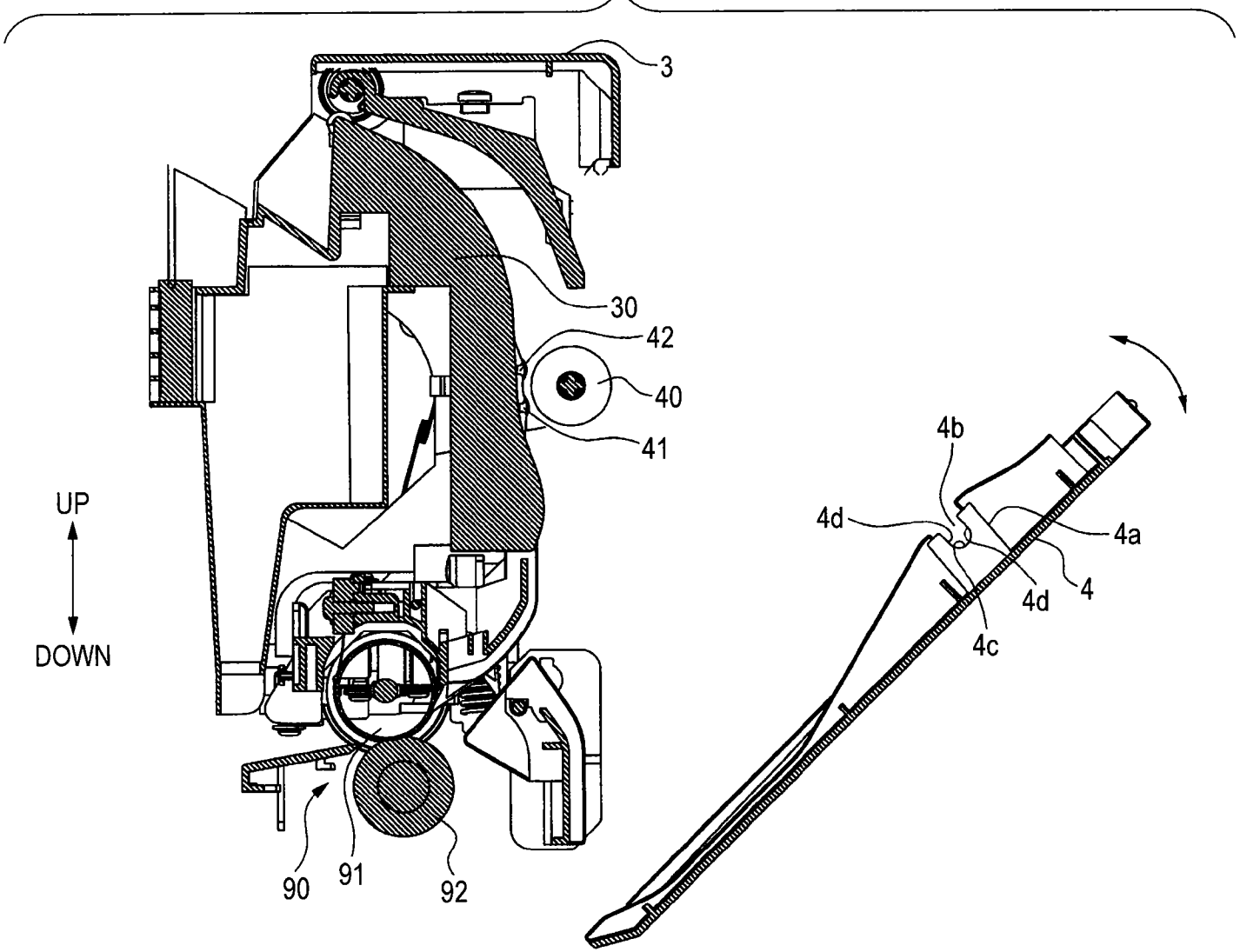
FIG. 5 is another sectional diagram view taken of FIG. 3 from a plane normal to the axial direction of the intermediate conveying rollers.
Figure 6:
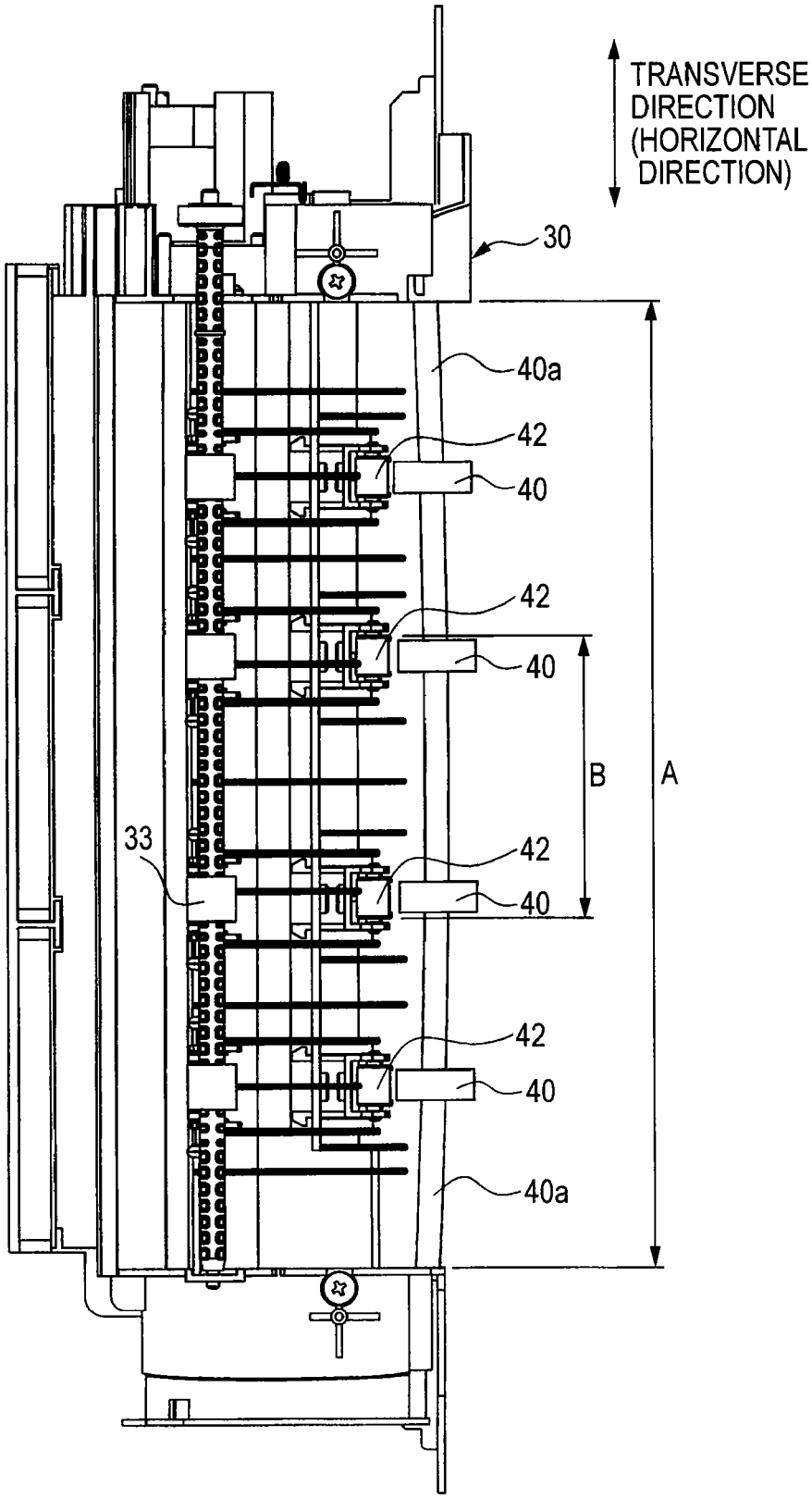
FIG. 6 is a top plan view of FIG. 3.
Figure 7:
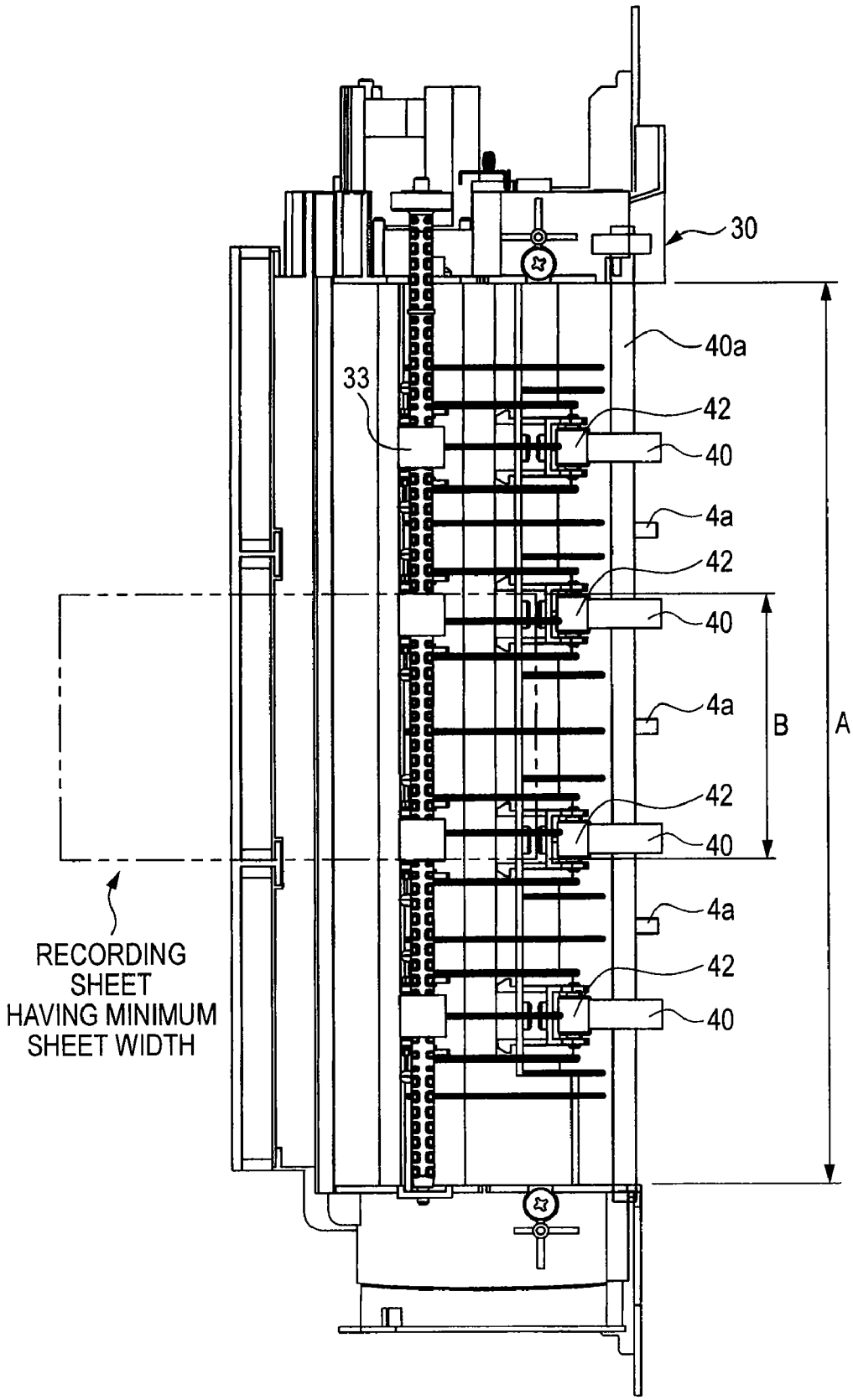
FIG. 7 is another top plan view of FIG. 3.
Figure 8A:
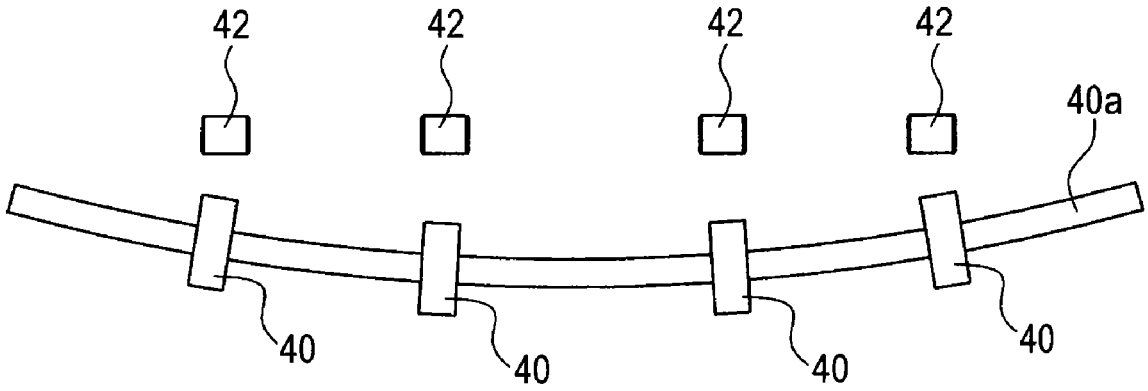
FIGS. 8A and 8B show states of the warped deformation of a spindle according to a first exemplary embodiment of the invention.
Figure 8B:
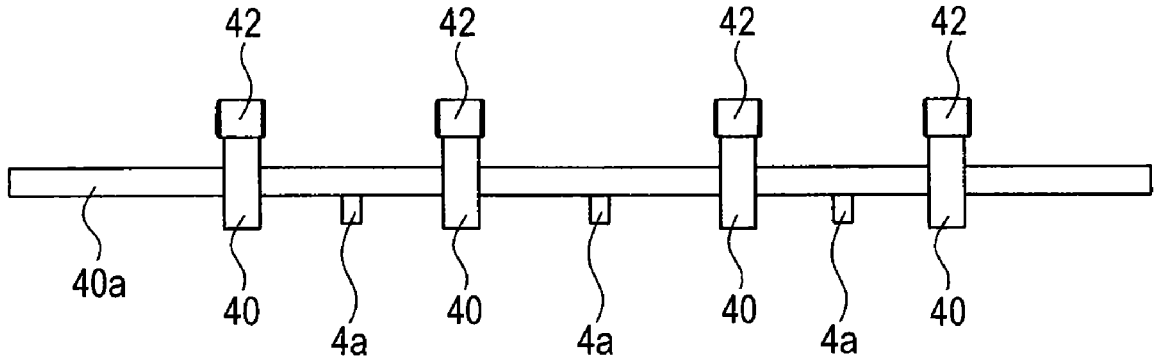

2.3. Discharge Chute and Intermediate Conveying Rollers 2.3.1. Structures of Discharge Chute and Intermediate Conveying Rollers FIG. 3 is an enlarged view of the discharge chute 30 and the intermediate conveying rollers 40. FIG. 4 and FIG. 5 are sectional diagrams showing views of FIG. 3 in a plane normal to the axial direction of the intermediate conveying rollers 40. FIG. 6 and FIG. 7 are top plan views of FIG. 3. FIGS. 8A and 8B are schematic diagrams showing states of the warped deformation of a spindle 40*a*.

The discharge chute 30 constitutes a guide wall for turning the recording sheet, as discharged from the fixing unit 90 (or the heating roller 91), as shown in FIG. 2, upward by about 180 degrees thereby to guide the recording sheet to the discharge rollers 33.

The intermediate conveying rollers 40, as disposed at the intermediate portion of the conveying path 31, comes into contact with the recording sheet being conveyed, from the side of the opening/closing cover 4, thereby to apply the conveying force to the recording sheet. These intermediate conveying rollers 40 are made, at least on their outer circumferences (although entirely in this example), of an elastically deformable material such as EPDM rubber.

Moreover, the rotations of the intermediate conveying rollers 40 are controlled in association with the discharge rollers 33. When an image is to be formed (or printed) on only one recording face of the recording sheet, the recording sheet conveyed is once conveyed toward the discharge rollers 33 and then stopped in association with the discharge rollers 33.

On the other hand, if images are to be formed (or printed) on both the front and back sides of the recording sheet, the recording sheet is turned back in association with the discharge rollers 33 so that it is conveyed on the double-sided printing path 35, when the trailing end portion of the conveyed recording sheet reaches the discharge rollers 33.

At positions confronting the intermediate conveying rollers 40 across the conveyed recording sheet, a pair of follower rollers 41 and 42 is arranged along the rotating directions of the intermediate conveying rollers 40, as shown in FIG. 3. The pair of follower rollers 41 and 42 is made of a hard material such as POM.

Moreover, the pair of follower rollers 41 and 42 is pushed by an urging unit (coil springs, not shown) towards the intermediate conveying rollers 40 as are connected by roller holders 44 disposed on the side of the discharge chute 30 (or the casing 3). As a result, the pair of follower rollers 41 and 42 pushes the recording sheet being carried toward the intermediate conveying rollers 40 and rotates while following the conveying of the recording sheet.

The pair of follower rollers 41 and 42, which is connected by the intermediate conveying rollers 40 and the roller holders 44, is provided in plurality in the widthwise direction (as will be called the "sheet width direction") of the recording sheet conveyed, as shown in FIG. 6 and FIG. 7. The plurality of follower rollers 41 and 42 are arranged substantially symmetrically with respect to the axially central portion of the spindle 40*a*.

Here, the sheet width direction is a direction perpendicular to both the conveying direction of the recording sheet and the thickness direction of the recording sheet. The sheet width direction is identical to the direction of the spindle 40*a* of the intermediate conveying rollers 40. Moreover, the axially central portion of the spindle 40*a* is the central portion in the sheet width direction of a conveying path width A, which is defined by the discharge chute 30, of the recording sheet.

The spindle 40*a* of the intermediate conveying rollers 40 is rotatably supported at its two end sides through bearings (not shown) by the discharge chute 30 (i.e., on the side of the casing 3), as shown in FIG. 6 and FIG. 7.

If the opening/closing cover 4 is closed, the portion of the spindle 40*a* between the bearings, which corresponds to the conveying path width A, is pushed towards the pair of follower rollers 41 and 42 (toward the conveyed recording sheet), as is supported by a protrusion 4*a* formed on the opening/closing cover 4, as shown in FIG. 4.

On the inner side of the opening/closing cover 4, the protrusion 4*a* is integrally molded which protrudes toward the intermediate conveying rollers 40. In the leading end side of the protrusion 4*a*, there is formed a substantially U-shaped recess 4*b*, which is opened on the side of the spindle 40*a* and extends in the horizontal direction. The spindle 40*a* is pushed in the bottom portion 4*c* of that recess 4*b* (i.e., at the horizontal end portion to the pair of follower rollers 41 and 42). The spindle 40*a* is supported by the horizontal portions 4*d* of the recess 4*b*.

The protrusion 4*a* is provided in plurality in the sheet width direction (or in the axial direction of the spindle 40*a*). These protrusions 4*a* are constituted such that the contact positions between the protrusions 4*a* (or the bottom portion 4*c*) and the spindle 40*a* are made substantially symmetric with respect to the axially central portion of the spindle 40*a*.

An n-number (i.e., four) of intermediate conveying rollers 40 are so arranged at positions equally dividing the conveying path width A into (n+1) (i.e., five) sections and are substantially symmetric with respect to the axially central portion of the spindle 40*a*. Further, the protrusions 4*a* are positioned at substantially central portions between the adjoining intermediate conveying rollers 40.

Moreover, at least one protrusion 4*a* and at least one intermediate conveying roller 40 are positioned within a range corresponding to a conveying path B, on which the recording sheet (as indicated by double-dotted lines in FIG. 7) having the minimum sheet width direction of the recording sheets to be conveyed is conveyed. At the same time, the protrusions 4*a* and the intermediate conveying rollers 40, as are disposed within the range corresponding to the conveying path B, are arranged substantially symmetrically with respect to the axial central portion of the conveying path B.

In this example, all the recording sheets to be conveyed on the conveying path A are so conveyed independently of their size that the central portion of the conveying path A and the width-wise central portion of the recording sheet may be aligned with each other. Independently of the size of the recording sheet, therefore, the contact portions between the recording sheet and the intermediate conveying rollers 40 are substantially symmetric with respect to the widthwise central portions of the recording sheets to be conveyed.

As shown in FIG. 3, the discharge chute 30 is provided with first guide ribs 36 and second guide ribs 37. The first guide ribs 36 and second guide ribs 37 protrude toward the recording sheet (or the conveying path 31) to be conveyed so that leading end sides of the first guide ribs 36 and second guide ribs 37 come into contact with the recording sheet and guide the conveying of the recording sheet.

Moreover, the first guide ribs 36 are disposed on the upstream side in the conveying direction of a contact portion P1 (as referred to FIG. 4) between the intermediate conveying rollers 40 and the first follower rollers 41 so as to guide the recording sheet to be conveyed to the contact portion P1. The second guide ribs 37 have guide portions 37*a* continuing from the upstream side in the conveying direction of the intermediate conveying rollers 40 to the downstream side in the conveying direction of the intermediate conveying rollers 40 thereby to guide the recording sheet.

The guide portions 37*a* are portions corresponding to the leading ends of the second guide ribs 37 and contact the recording sheet to be conveyed so as to guide the conveying direction of the recording sheet. Likewise, the first guide ribs 36 have guide portions 36*a* which are the leading ends of the first guide ribs 36. These leading ends contact the recording sheet to be conveyed, to guide the conveying direction of the recording sheet. The guide portions 36*a* of the first guide ribs 36 disappear near the contact portion P1.

2.3.2. Conveyance of Recording Sheet in Discharge Chute and Intermediate Conveying Rollers The recording sheet discharged from the fixing unit 90 is guided by the first guide ribs 36 and clamped between the first follower rollers 41 and the intermediate conveying rollers 40. The recording sheet discharged from the first follower rollers 41 is guided by the second guide ribs 37 to a contact portion P2 (as referred to in FIG. 4) between the second follower rollers 42 and the intermediate conveying rollers 40. The recording sheet discharged from the first follower rollers 42 is then fed out to the discharge rollers 33 while being clamped between the second follower rollers 42 and the intermediate conveying rollers 40.

At this time, the recording sheet is forcibly curled on the intermediate conveying rollers 40. As a result, the recording sheet having acquired a bending tendency to bulge backward is so forcibly curved as to bulge backward (or to the front side). Accordingly, the bending tendency (or the curl) having occurred at or downstream of the fixing unit 90 can be offset.

In the case of a double-sided printing operation, the recording sheet discharged from the fixing unit 90 and having completed the image formation (or printing) on the surface side is conveyed along a conveying path L1 indicated by a solid line in FIG. 4 to the discharge rollers 33.

When the trailing end side of the recording sheet in the conveying direction reaches the discharge rollers 33, the rotating directions of the discharge rollers 33 and the intermediate conveying rollers 40 are reversed in order to convey the recording sheet along a conveying path L2 indicated by a broken line of FIG. 4 to the double-sided printing path 35. The recording sheet is conveyed again to the image forming unit 10 through the double-sided printing path (as referred to FIG. 2) disposed above the sheet feed tray 21.

2.3.3. Opening/Closing of Opening/Closing Cover, and Pressure of Spindle

When the opening/closing cover 4 is opened, as shown in FIG. 6 and FIG. 8A, the spindle 40*a* is warped to bulge toward an opening/closing door 32. In this state, the intermediate conveying rollers 40 and the pair of follower rollers 41 and 42 are either in a noncontact state or in a state where the contacting facial pressure is so low that sufficient conveying force cannot be applied.

When the opening/closing cover 4 is closed, as shown in FIG. 7 and FIG. 8B, the spindle 40*a* is so warped toward the pair of follower rollers 41 and 42 as to become straight. As a result, the intermediate conveying rollers 40 are pushed toward the pair of follower rollers 41 and 42. Accordingly, the contacting facial pressure between the intermediate conveying rollers 40 and the pair of follower rollers 41 and 42 can be raised.

3. Features of Laser Printer

If the opening/closing cover 4 is closed, the protrusions 4*a* push the intermediate conveying rollers 40 toward the recording sheet, as shown in FIG. 4. When the opening/closing cover 4 is closed, therefore, the contacting facial pressure between the recording sheet and the intermediate conveying rollers 40 can be set to at least a predetermined facial pressure.

If the opening/closing cover 4 is opened, the intermediate conveying rollers 40 are slightly displaced in association with the opening/closing cover 4 toward the opening/closing cover 4, as shown in FIG. 5, thereby releasing the pushing force. Therefore, when the opening/closing cover 4 is opened, the contacting facial pressure between the recording sheet and the intermediate conveying rollers 40 can be lowered to a level lower than a predetermine facial pressure.

Therefore, if the opening/closing cover 4 is closed, the contacting facial pressure between the recording sheet and the intermediate conveying rollers 40 can be set to at least a predetermined facial pressure to thereby stably convey the recording sheet. When the opening/closing cover 4 is opened, on the other hand, the contacting facial pressure between the recording sheet and the intermediate conveying rollers 40 can be lowered to easily remove the jammed recording sheet.

Further, in this example, the intermediate conveying rollers 40 are arranged on the side of the opening/closing cover 4 of the recording sheet to be conveyed. As a result, the intermediate conveying rollers 40 can be more easily pushed toward the recording sheet than when the intermediate conveying rollers 40 are arranged on the opposite side of the opening/closing cover 4 across the recording sheet to be conveyed.

More specifically, if the intermediate conveying rollers 40 are arranged on the opposite side of the opening/closing cover 4 across the recording sheet to be conveyed, it is necessary to provide a lever mechanism or the like for inverting the direction of the pushing force by the protrusions 4*a*. On the other hand, as in this example, if the intermediate conveying rollers 40 are arranged on the side of the opening/closing cover 4 of the recording sheet to be conveyed, the aforementioned lever mechanism is not needed. As a result, the intermediate conveying rollers 40 can be easily pushed by the protrusions 4*a* toward the recording sheet, and the object of the invention can be achieved while suppressing size enlargement and manufacturing cost of the laser printer 1.

Further, in this example, the protrusions 4*a* are formed within the range corresponding to the conveying path B, on which such one of the recording sheets to be conveyed having the minimum sheet width direction is conveyed. Even in this case, the contacting facial pressure between the intermediate conveying rollers 40 and the recording sheet can be set to at least a predetermined level. As a result, even a small recording sheet can be stably conveyed.

Further, in this example, the intermediate conveying rollers 40 are arranged substantially symmetrically with respect to the axially central portion of the spindle 40*a*, and the contact positions between the protrusions 4*a* and the spindle 40*a* are substantially symmetric with respect to the axially central portion of the spindle 40*a*. As a result, multiple contact portions between the recording sheet and the intermediate conveying rollers 40 exist, and these contact portions are substantially symmetric with respect to the axially central portion. This makes it possible to suppress the conveyance problem of having the recording sheet inclined with respect to the conveying direction.

On the end side of the spindle 40*a* closer to the conveying path A, there is normally arranged a drive mechanism for driving the spindle 40*a* (or the intermediate conveying rollers 40) rotationally. If the end portion side of the spindle 40*a* closer to the conveying path A is pushed to the protrusions 4*a*, the space for contacting the protrusions 4*a* and spindle 40*a* while avoiding the interference with the drive mechanism has to be retained, which results in the size enlargement of the laser printer 1.

On the contrary, in this example, a portion of the spindle 40*a* which corresponds to the conveying path A is pushed. Accordingly, the space for causing the protrusions 4*a* and the spindle 40*a* to contact can be retained without increasing the size of the laser printer 1.

In this example, the contacting facial pressure between the intermediate conveying rollers 40 and the pair of follower rollers 41 and 42 are set to at least a predetermined level by pushing and warping the spindle 40*a*. The spindle 40*a* cannot be warped if its rigidity is excessively high, and the contacting facial pressure between the intermediate conveying rollers 40 and the pair of follower rollers 41 and 42 may be unable to be set to at least a predetermined level.

Therefore, the spindle 40*a* can be easily warped when made of a resin such as PC, so that the intermediate conveying rollers 40 can be easily displaced to easily establish a predetermined contacting facial pressure.

Due to the manufacturing size dispersion of the opening/closing cover 4 or the protrusions 4*a* (or the recess 4*b*), or the size dispersion in assembling the opening/closing cover 4 in the casing 3, the intermediate conveying rollers 40 may be excessively displaced toward the recording sheet.

If the outer circumference sides of the intermediate conveying rollers 40 are so rigid as not to be elastically deformed when the intermediate conveying rollers 40 are excessively displaced toward the recording sheet, the contacting facial pressure between the intermediate conveying rollers 40 and the recording sheet may be excessively raised, leading to damage of the recording sheet.

On the contrary, in this example, the intermediate conveying rollers 40 are made of an elastically deformable material. Therefore, even if the intermediate conveying rollers 40 are excessively displaced toward the recording sheet, the intermediate conveying rollers 40 are deformed at their outer circumference sides so that excessive displacements can be absorbed.

Therefore, the contacting facial pressure between the intermediate conveying rollers 40 and the recording sheet can be prevented in advance from becoming excessively high. Thus, the damage of the recording sheet can be prevented in advance.

Here, in order to remove the bending tendency (or the curl) having occurred at the recording sheet, it is necessary to curve the recording sheet forcibly in the direction opposite to that of the bending tendency, as has been described hereinbefore. As a result, clogging (or jamming) of the recording sheet is liable to occur at the portion where the rollers for removing the bending tendency (or the curl) are disposed.

It is thus more effective to apply the invention to the portion where the rollers for removing the bending tendency (or the curl) are disposed.

On the other hand, the bending tendency is liable to occur especially at the fixing unit 90. Therefore, it is more effective to apply the invention to the downstream side of the fixing unit 90 in the conveying direction.

Further, in this example, the spindle 40*a* is supported while being pushed by the protrusions 4*a* (or the recess 4*b*). Thus, the intermediate conveying rollers 40 can be reliably supported/pushed while being positioned.

Incidentally, the image forming unit 10 corresponds to an image forming unit. The intermediate conveying rollers 40 correspond to a conveying roller. The bottom portion 4*c* of the protrusions 4*a* (or the recess 4*b*) corresponds to a pushing unit. The first follower rollers 41 and the second follower rollers 42 correspond to a plurality of rollers.

Second Exemplary Embodiment

Figure 9A:
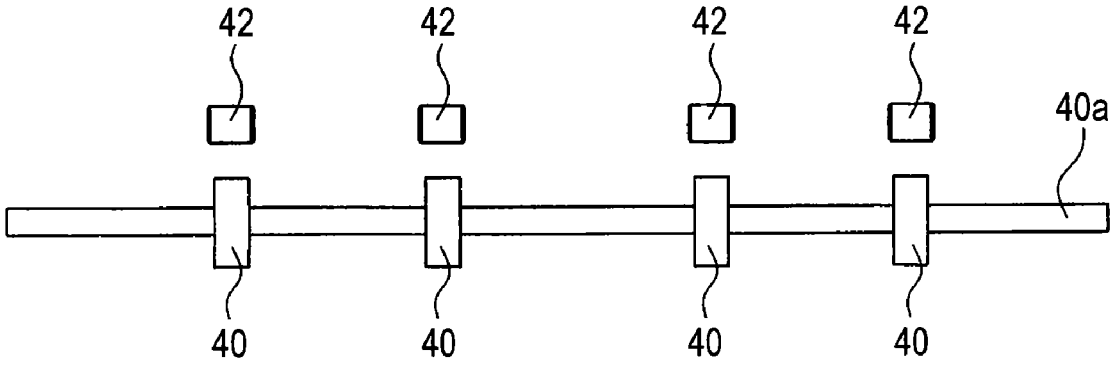
FIGS. 9A and 9B show states of the warped deformation of a spindle according to a second exemplary embodiment of the invention.
Figure 9B:
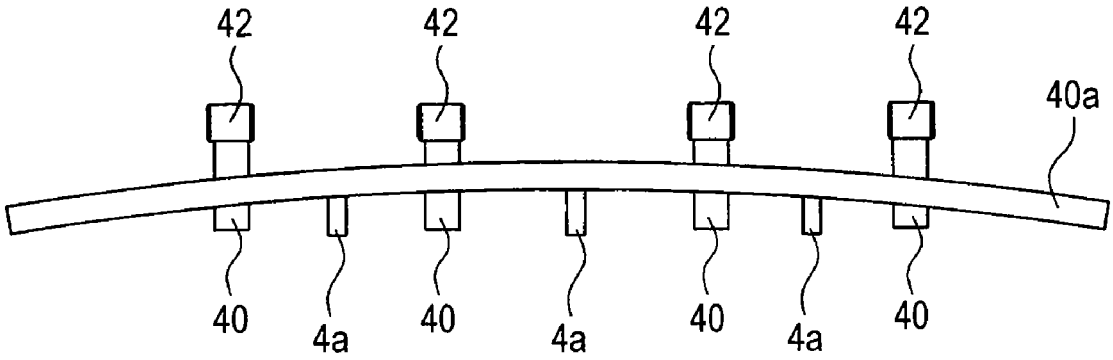

FIGS. 9A and 9B show states of the warping deformations of the spindle 40*a* according to a second exemplary embodiment of the invention.

As discussed above, in a state where the opening/closing cover 4 is opened, the spindle 40*a* is warped to bulge toward the opening/closing door 32. However, in this exemplary embodiment, the spindle 40*a* is substantially straight, as shown in FIG. 9A, with the opening/closing cover 4 being opened. When the opening/closing cover 4 is closed, the spindle 40*a* is pushed by the protrusions 4*a*, as shown in FIG. 9B, so that the spindle 40*a* is warped toward the pair of follower rollers 41 and 42 thereby raising the contacting facial pressure between the intermediate conveying rollers 40 and the pair of follower rollers 41 and 42 to at least a predetermined level.

Third Exemplary Embodiment

Figure 10:
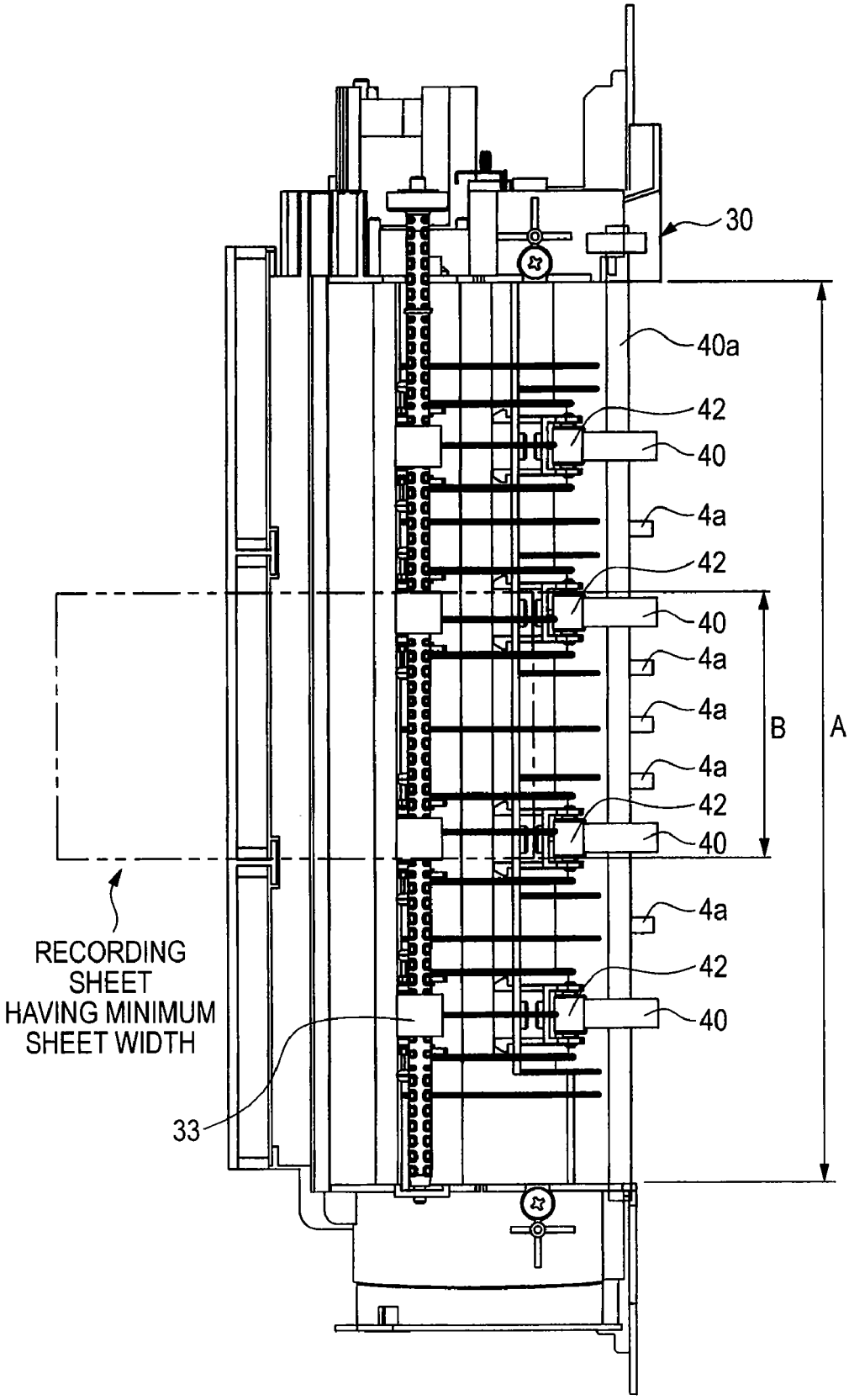
FIG. 10 is a top plan view of a discharge chute according to a third exemplary embodiment of the invention.

FIG. 10 is a top plan view of the discharge chute 30 according to a third exemplary embodiment of the invention.

As discussed above, one protrusion 4*a* is within the range corresponding to the conveying path B, on which one having the minimum sheet width direction of the recording sheets to be conveyed is conveyed. In this example, however, a plurality (e.g., three) of protrusions 4*a* is within the range corresponding to the conveying path B, as shown in FIG. 10.

As a result, the contacting facial pressure between the recording sheet and the intermediate conveying rollers 40 can be set to at least a predetermined level, even if the recording sheet has the minimum sheet width direction, so that the recording sheet can be reliably conveyed.

FIG. 10 applies this example to the first example described above. However, this invention should not be limited thereto but can also be applied to the second example.

(Other Example Structures)

In the foregoing exemplary embodiments, the protrusions 4*a* (or the recess 4*b*) are provided with the function of the pushing unit and the function of a supporting unit. However, the invention is not limited thereto, but may be provided at least with the function of the pushing unit.

Further, in the foregoing exemplary embodiments, the protrusions 4*a* and the intermediate conveying rollers 40 are arranged symmetrically at the axially central portion. However, the invention should not be limited thereto.

Still further, in the foregoing exemplary embodiments, the protrusions 4*a* are disposed within the range corresponding to the conveying path B where one having the minimum sheet width direction of the recording sheets is conveyed. However, the invention should not be limited thereto.

Still further, in the foregoing exemplary embodiments, the spindle 40*a* is made of a resin. However, the invention should not be limited thereto, but may be constituted such that the spindle 40*a* is made of a metal to enable the spindle 40*a* to move in parallel toward the pair of follower rollers 41 and 42.

Moreover, the invention should not be limited to the foregoing aspects, but instead be defined in scope by the appended claims.

What is claimed is:

1. An image forming apparatus comprising:

an image forming unit which forms an image on a recording sheet;

a casing which houses the image forming unit and holds the image forming unit;

a follower roller;

a conveying roller which is provided on the casing, confronts the follower roller, contacts the recording sheet to be conveyed in the casing, conveys the recording sheet, and is supported to rotate by the casing, the conveying roller having a spindle; and a cover which opens and closes an opening formed in a portion of the casing which corresponds to the conveying roller, wherein the conveying roller is arranged on a cover side of the recording sheet to be conveyed and the follower roller is arranged on the opposite side of the recording sheet, the cover including a pushing unit having a protrude portion, wherein if the cover is closed, the pushing unit directly contacts the spindle of the conveying roller and exerts a pushing force to push the conveying roller toward the recording sheet to act on the spindle and the protrude portion protrudes toward the conveying roller and contacts the spindle, and wherein if the cover is opened, the pushing unit releases the pushing force by moving in association with the cover.

2. The image forming apparatus according to claim 1, wherein the pushing unit is disposed at a position within a range corresponding to a conveying path, on which a recording sheet having a minimum sheet width direction is conveyed.

3. The image forming apparatus according to claim 1, wherein the conveying roller is arranged to be substantially symmetric with respect to a substantially central portion in an axial direction of the spindle, and wherein contact positions between the pushing unit and the spindle are substantially symmetric with respect to the substantially central portion in the axial direction of the spindle.

4. The image forming apparatus according to claim 1, wherein the spindle is made of a resin.

5. The image forming apparatus according to claim 1, wherein at least an outer circumference of the conveying roller is made of an elastically deformable material.

6. The image forming apparatus according to claim 1, further comprising a plurality of follower rollers which push the recording sheet toward the conveying roller at positions that confront the conveying roller and along the rotational direction of the conveying roller.

7. The image forming apparatus according to claim 1, wherein the image forming unit includes a fixing unit which heats a toner transferred to the recording sheet and fixes the toner on the recording sheet, and wherein the conveying roller is arranged on a downstream side of the fixing unit in a conveying direction of the recording sheet.

8. The image forming apparatus according to claim 1, wherein the conveying roller conveys the recording sheet discharged from the image forming unit and conveys the recording sheet which is to be conveyed again to the image forming unit after discharge from the image forming unit.

9. The image forming apparatus according to claim 1, wherein the pushing unit includes a supporting unit which supports the spindle.

* * * * *